US008793907B2

(12) United States Patent
Walimaa et al.

(10) Patent No.: US 8,793,907 B2
(45) Date of Patent: Aug. 5, 2014

(54) SNOWPLOW BLADE ARTICULATOR ASSEMBLY WITH PASSIVE DOWNFORCE MECHANISM

(75) Inventors: Jon K. Walimaa, Kingsford, MI (US); Jody Christy, Iron Mountain, MI (US)

(73) Assignee: Northern Star Industries, Inc., Iron Mountain, MI (US)

( * ) Notice: Subject to any disclaimer, the term of this patent is extended or adjusted under 35 U.S.C. 154(b) by 178 days.

(21) Appl. No.: 13/486,242

(22) Filed: Jun. 1, 2012

(65) Prior Publication Data

US 2013/0318838 A1 Dec. 5, 2013

(51) Int. Cl.
*E01H 5/04* (2006.01)

(52) U.S. Cl.
USPC ..... 37/234

(58) Field of Classification Search
USPC ..... 37/196, 197, 232–236, 466, 348; 172/2–11, 45, 801, 810, 812, 828, 830, 172/831, 261, 263–265; 414/699, 685; 60/494; 91/6, 31, 33
See application file for complete search history.

(56) References Cited

U.S. PATENT DOCUMENTS

| | | | | |
|---|---|---|---|---|
| 4,658,519 | A | 4/1987 | Quenzi | |
| 5,265,356 | A * | 11/1993 | Winter | 37/234 |
| 5,901,476 | A * | 5/1999 | Buonfiglio | 37/234 |
| 5,921,010 | A * | 7/1999 | Schulte et al. | 37/232 |
| 5,987,785 | A | 11/1999 | Aguado et al. | |
| 6,044,579 | A | 4/2000 | Hadler et al. | |
| 6,154,986 | A | 12/2000 | Hadler et al. | |
| 6,163,985 | A * | 12/2000 | Chinnery et al. | 37/234 |
| 6,253,470 | B1 * | 7/2001 | Depies et al. | 37/234 |
| 6,467,553 | B1 * | 10/2002 | Wojanis | 172/812 |
| 6,640,468 | B2 | 11/2003 | Menze | |
| 7,793,440 | B1 | 9/2010 | Ropog | |
| 2009/0282706 | A1 | 11/2009 | Barker et al. | |

OTHER PUBLICATIONS

Homesteader™ Personal Plow (Hydraulic Unit (PN 27517)—Schematic), Jun. 2008.

* cited by examiner

*Primary Examiner* — Robert Pezzuto
(74) *Attorney, Agent, or Firm* — Marshall, Gerstein & Borun LLP

(57) ABSTRACT

A snowplow blade articulator assembly includes a mounting frame for attaching a snowplow blade to a vehicle chassis. A hydraulic pump and a hydraulic reservoir are attached to the mounting frame, the hydraulic reservoir supplying hydraulic fluid to the hydraulic pump. An articulating assembly is attached to the mounting frame for moving the snowplow blade when the snowplow blade is attached to the mounting frame, the articulating assembly is fluidly connected to the hydraulic pump, and the articulating assembly includes a lift cylinder and a hydraulic manifold. The hydraulic manifold includes a downforce circuit that fluidly isolates the lift cylinder from the hydraulic pump when a first control valve is closed and the downforce circuit fluidly connects a lift chamber of the lift cylinder with a lower chamber of the lift cylinder to maintain equal hydraulic pressure in the lift chamber and in the lower chamber.

11 Claims, 3 Drawing Sheets

SNOWPLOW BLADE ARTICULATOR ASSEMBLY WITH PASSIVE DOWNFORCE MECHANISM

BACKGROUND

1. Field of the Disclosure

This disclosure relates generally to articulators for snowplow blades and, more specifically, to snowplow blade articulators having a passive downforce mechanism.

2. Related Technology

Generally speaking, snowplow blade assemblies come in two different types, an assembly having a straight blade and an assembly having an adjustable or V-blade. The straight blade generally extends across the front of a vehicle, such as a truck. Some straight blades may be angularly adjustable relative to the longitudinal axis of the vehicle. For example, some straight blades may have the capability to angle the straight blade relative to the longitudinal axis of the vehicle to the left or to the right.

V-blades are formed by two wings or blades (a driver's side blade or left wing, and a passenger's side blade or right wing) that meet at a center hinge. Each blade may be independently adjustable relative to the longitudinal axis of the vehicle. As a result, the V-blade may have multiple useful configurations. For example, the V-blade may take on a V-shape with each blade extending at an angle from the center hinge, rearwardly toward the vehicle. The V-blade may also take on an inverted V-shape or scoop configuration, where each blade extends at an angle forward from the center hinge, away from the vehicle. Finally, the V-blade may mimic a straight blade by having one blade extend forward from the center hinge and another blade extending rearward from the center hinge. As a result of the different configurations, the V-blade is known to be generally more adaptable to unique plow areas, especially confined plow areas.

Most snowplow blade assemblies include hydraulically or manually operated articulators for lowering and raising the snowplow blade. These articulators, especially the hydraulically actuated articulators, may also include mechanisms for adjusting an angle of the snowplow blade relative to a vehicle longitudinal axis. Some articulators may also be capable of adjusting portions of the snow plow blade relative to other portions of the snowplow blade, for example, different wings of a V-blade. Generally speaking, hydraulically actuated snowplow blade articulators use hydraulic force to raise the snowplow blade off of the ground when not in use. These articulators remove hydraulic pressure to lower the snowplow blade to the ground for plowing snow. When the snowplow blade is lowered to the ground for plowing snow, the weight of the snowplow blade keeps it on the ground.

In practice, plowing areas are rarely flat and level. To the contrary, most plowing areas have uneven terrain and even obstacles extending upward from the plowing surface, such as curbs, manhole covers, reflectors, ADA-mandated tactile warning tiles, and other objects. Snowplow blades must have the capability to adjust to the uneven terrain and to overcome the obstacles without breaking the obstacle or the blade. Generally speaking, hydraulically actuated snowplow blades are placed in a "float" mode in which hydraulic fluid pressure is removed from the articulator and the weight of the snowplow blade is depended upon to keep the snowplow blade in contact with the plowing surface. However, during certain environmental conditions, such as heavy wet snow, or ice laden snow, the weight of the snowplow blade may not be sufficient to keep the snowplow blade in contact with the plowing surface and the snowplow blade may ride up over the heavy snow or ice. This problem is especially prevalent with lightweight snowplow blades that are mounted on small trucks or utility vehicles.

In an attempt to overcome this problem, some hydraulic articulators have included a hydraulic lock, which locks the snowplow blade in the down position. However, when hydraulically locking the snowplow blade in the down position, the snowplow blade is not capable of moving over small obstacles or adjusting to uneven terrain. As a result, this hydraulic downlock is only beneficial in certain narrow conditions, for example, when plowing nearly level and obstacle free surfaces.

An active downforce mechanism has been used to overcome this problem. One example of an active downforce mechanism is disclosed in U.S. Pat. No. 5,897,786, which is hereby incorporated by reference herein. The disclosed active downforce mechanism includes a pressure switch, which senses pressure in a hydraulic cylinder. When the pressure drops below a certain level, such as when the snowplow blade drops into a recess in the plowing surface, the pressure switch activates a hydraulic pump to supply additional hydraulic fluid pressure. When the pressure rises above a certain level, a pressure relief valve vents excess hydraulic fluid to a reservoir to relieve the pressure. While this active downforce mechanism is effective in providing additional force to the snowplow blade to keep it in contact with the plowing surface, the constant actuation of the hydraulic pump often results in premature pump failure. Moreover, impact forces are transmitted through the hydraulic system and through the mounting hardware directly to the vehicle, where the operator is subject to the same impact forces, before the active downforce mechanism can react and raise or lower the hydraulic pressure.

SUMMARY

A snowplow blade articulator assembly includes a mounting frame for attaching a snowplow blade to a vehicle chassis. A hydraulic pump and a hydraulic reservoir are attached to the mounting frame, the hydraulic reservoir supplying hydraulic fluid to the hydraulic pump. An articulating assembly is attached to the mounting frame for moving the snowplow blade when the snowplow blade is attached to the mounting frame, the articulating assembly is fluidly connected to the hydraulic pump, and the articulating assembly includes a lift cylinder and a hydraulic manifold. The hydraulic manifold includes a downforce circuit that fluidly isolates the lift cylinder from the hydraulic pump when a first control valve is closed and the downforce circuit fluidly connects a lift chamber of the lift cylinder with a lower chamber of the lift cylinder to maintain equal hydraulic pressure in the lift chamber and in the lower chamber.

In one embodiment, the manifold includes a hydraulic fluid supply line, a first control valve fluidly connected to the hydraulic fluid supply line, the first control valve controlling hydraulic fluid flow to a lift chamber of a lift cylinder, a second control valve fluidly connected to the first control valve downstream of the first control valve, the second control valve controlling hydraulic fluid flow to a lower chamber of the lift cylinder, and a third control valve fluidly connected to the second control valve downstream of the second control valve, the third control valve operating to fluidly isolate a downforce circuit from a hydraulic reservoir when the third control valve and the second control valves are closed.

A method of operating a snowplow blade with downforce includes providing a lift cylinder for operating a snowplow blade, the lift cylinder having a lift chamber and a lower chamber, providing a hydraulic manifold that is fluidly connected to the lift chamber and the lower chamber, and operating a first control valve and a second control valve in the hydraulic manifold to fluidly isolate the lift cylinder from a hydraulic pump while fluidly connecting the lift chamber and the lower chamber.

DETAILED DESCRIPTION OF THE PREFERRED EMBODIMENT

Generally speaking, the passive downforce mechanisms disclosed herein isolate a lift cylinder portion of a hydraulic circuit and fluidly connect both sides of the lift cylinder to one another. More specifically, when a downforce mode is activated, an isolation valve closes to isolate the lift cylinder when the hydraulic pump is turned off. As a result, hydraulic pressure is trapped on both sides of the lift cylinder. The lift cylinder includes a piston having a lower surface in the lower chamber and a lift surface in the lift chamber. The lower surface has a larger surface area than the lift surface. Because the hydraulic pressure trapped in the lift cylinder is equal on both sides of the lift cylinder, and because there is more surface area in the lower chamber than in the lift chamber, a downforce is generated that is larger than an upforce that is generated. As a result, the snowplow blade is forced downward, towards the plowing surface, without being locked in the down position. Thus, the disclosed downforce mechanisms improve snowplow blade performance in certain environmental conditions, and during back pull plowing, while still allowing the snowplow blade to adjust to variations in elevation of the plowing surface, and to deflect over obstacles on the plowing surface.

Additionally, the downforce mechanisms disclosed herein may include a hydraulic accumulator that is fluidly connected to the isolated lift cylinder. The hydraulic accumulator acts as a shock absorber that accommodates some variation in hydraulic pressure due to movement of the snowplow blade. For example, if the snowplow blade deflects upward, due to an obstacle or increasing elevation, the accumulator accepts excess hydraulic fluid, which maintains a desired hydraulic pressure within both chambers of the lift cylinder. Similarly, if the snowplow blade deflects downward due to a decrease in surface elevation, the hydraulic accumulator supplies additional hydraulic fluid to both chambers of the lift cylinder to maintain a substantially constant hydraulic pressure across both chambers of the lift cylinder. In one embodiment, the hydraulic accumulator may include a bladder that is pressurized with a gas, such as nitrogen. In other embodiments, the hydraulic accumulator may take on other forms, such as a gas energized piston, or a spring energized piston type of accumulator. Regardless, the shock absorbing feature of the hydraulic accumulator significantly reduces hydraulic pump cycling and/or pressure relief valve actuation, which increases service life of those components. The shock absorbing function of the hydraulic accumulator also reduces forces that are transmitted to the vehicle chassis when obstacles are encountered, which improves ride quality for an operator of the vehicle.

Figure 1:
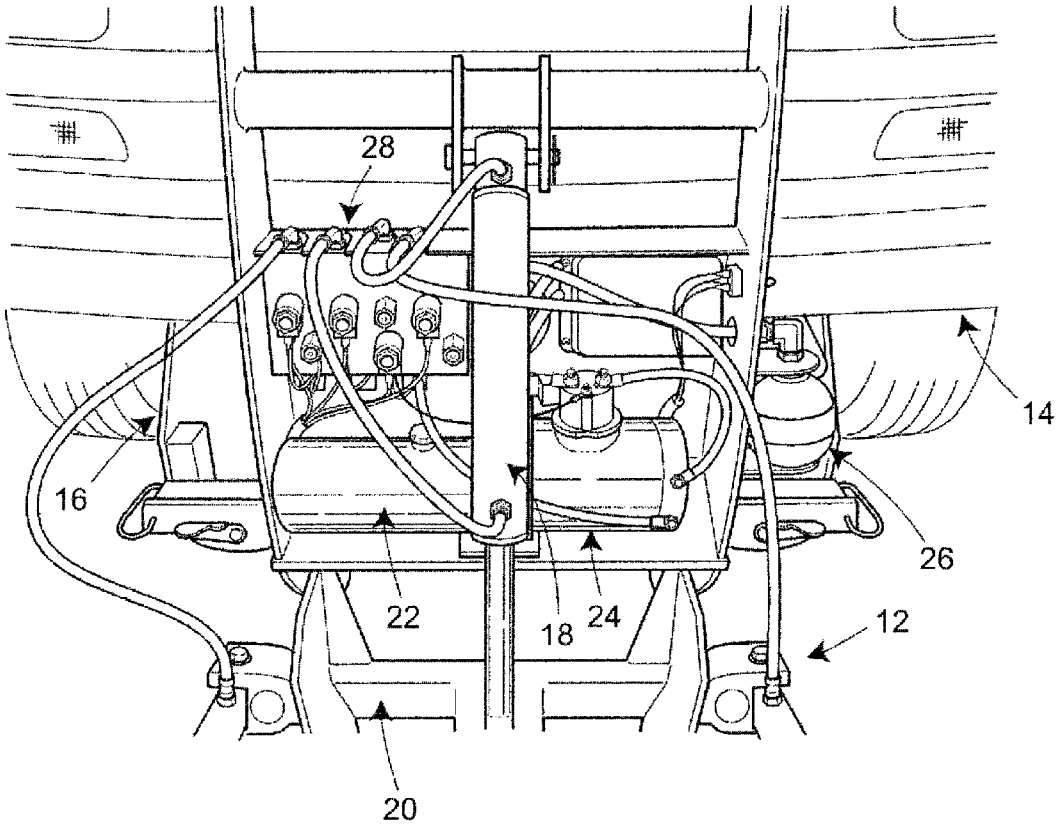
FIG. 1 is a front view of a vehicle chassis having a snowplow blade mounting assembly attached thereto.

Turning now to FIG. 1, a snowplow blade actuation system 10 is illustrated. The snowplow blade actuation system 10 includes a mounting frame 12 that is attached to a vehicle chassis 14. An articulating assembly 16 moves the snowplow blade up and down. The articulating assembly 16 may include a hydraulic lift cylinder 18 that is connected to a movable frame 20. The snowplow blade (not shown) is mounted on the movable frame 20. A hydraulic reservoir 22 supplies hydraulic fluid to a hydraulic pump 24, which supplies pressurized hydraulic fluid to the hydraulic lift cylinder 18. A hydraulic accumulator 26 is fluidly connected to the hydraulic lift cylinder 18. A manifold 28 includes electrical circuitry and control valves to control movement and operation of the articulating assembly 16.

Figure 2:
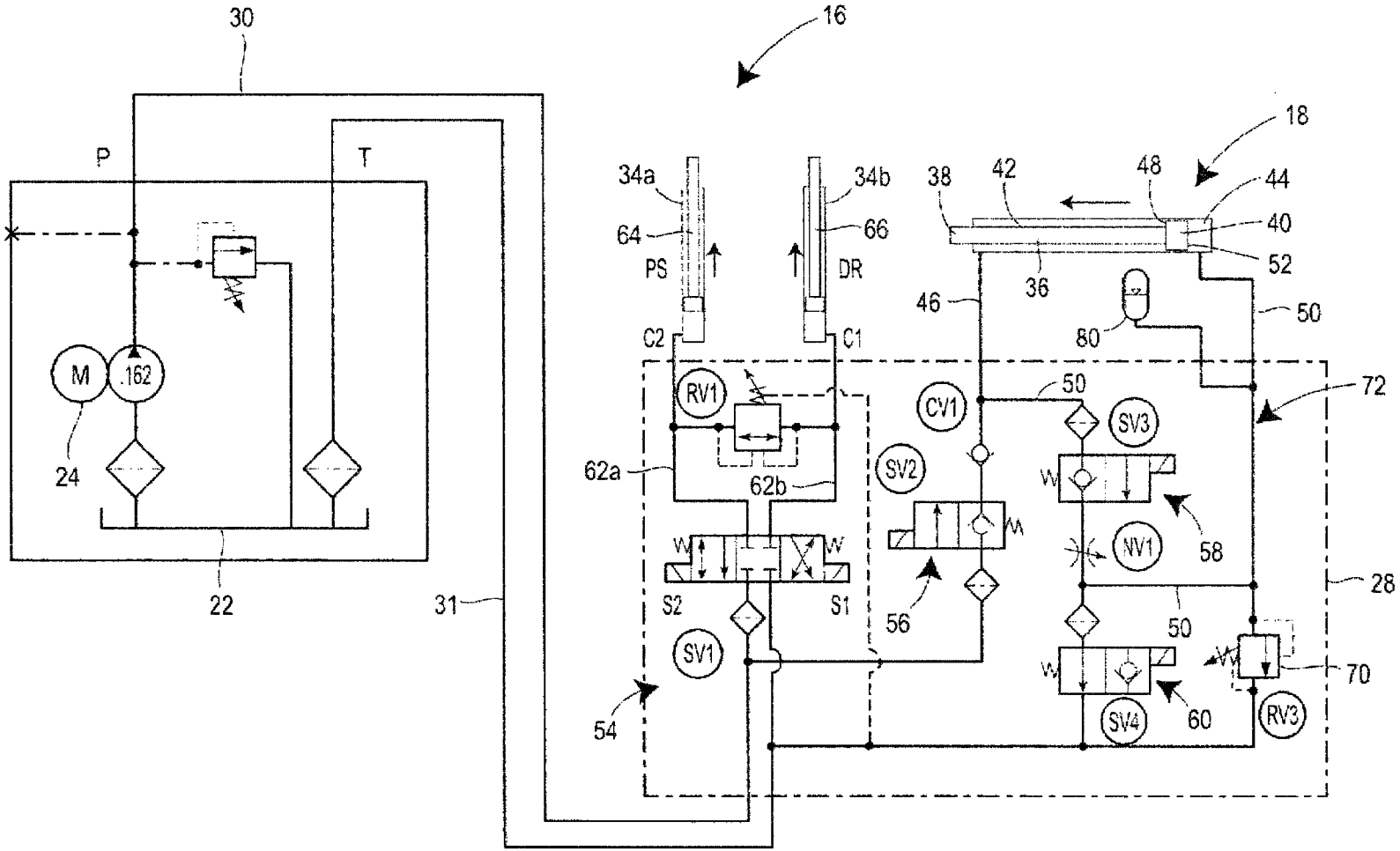
FIG. 2 is a schematic diagram of a hydraulic articulating assembly of the snowplow blade mounting assembly of FIG. 1, the hydraulic articulating assembly having a passive downforce mechanism.

FIG. 2 illustrates on embodiment of the articulating assembly 16. Generally speaking, the articulating assembly 16 includes the hydraulic reservoir 22, the hydraulic pump 24, the manifold 28, and the lift cylinder 18. The hydraulic pump 24 supplies pressurized hydraulic fluid from the hydraulic reservoir 22 through supply line 30 to the manifold 28, where the pressurized hydraulic fluid is routed as desired to affect movement of the lift cylinder 18 and/or angle cylinders 34*a*, 34*b*. Hydraulic fluid is returned to the reservoir 22 through a return line 31.

The lift cylinder 18 includes a piston 36 that is attached to the articulating frame 20 at a first end 38. A second end 40 of the piston 36 separates the lift cylinder 18 into a lift chamber 42 and a lower chamber 44. The manifold 28 directs pressurized hydraulic fluid into the lift chamber 42 through lift line 46 to lift the snowplow blade. The pressurized hydraulic fluid in the lift chamber 42 acts on a lift surface 48 of the piston 36 to produce a force (to the right in FIG. 2), which lifts the snowplow blade. To lower the snowplow blade, the manifold 28 relieves pressure in the lower chamber 44 by diverting hydraulic fluid in the lower chamber 44 back to the hydraulic reservoir 22 through lower line 50, which allows the snowplow blade to fall under its own weight.

The manifold 28 includes, inter alia, hydraulic lines, control valves, and electrical circuitry that an operator may manipulate to route pressurized hydraulic fluid to the lift cylinder 18 (and/or to the angle cylinders 34*a*, 34*b*), which ultimately produces forces that move the snowplow blade in a desired direction. In particular, the manifold 28 includes a first control valve 54, a second control valve 56, a third control valve 58, and a fourth control valve 60 that cooperate with one another to direct pressurized hydraulic fluid to the desired locations. A control panel (not shown) located in the cab of a vehicle may be used to electrically position the control valves 54, 56, 58, 60.

More specifically, the first control valve 54 ports pressurized fluid to the first and second angle cylinders 34*a*, 34*b* through first and second angle lines 62*a*, 62*b*. When an operator desires to angle the snowplow blade to the right, the operator selects an angle right function on the control panel. The control panel electrically signals the first control valve 54 to port pressurized hydraulic fluid to the first angle cylinder 34*a*, which extends a first angle piston 64, causing the left side of the snowplow blade to move forward, which angles the snowplow blade to the right (relative to the operator). Similarly, when the operator desires to angle the snowplow blade to the left, the operator selects an angle left function on the control panel. The control panel electrically signals the first control valve 54 to port pressurized hydraulic fluid to the second angle cylinder 34*b*, which extends a second angle piston 66, causing the right side of the snowplow blade to move forward, which angles the snowplow blade to the left (relative to the operator).

In a similar fashion, the second control valve 56 ports pressurized hydraulic fluid to the lift cylinder 18 through the lift line 46 and/or through the lower line 50. When the operator desires to lift the snowplow blade, the operator selects a lift function on the control panel. The control panel electrically signals the second control valve 56 to port fluid to the lift chamber 42, which causes the piston 36 to move to the right in FIG. 2, in turn causing the snowplow blade to lift. When the operator desires to lower the snowplow blade, the operator selects a lower function on the control panel. The control panel electrically signals the third control valve 58 to open, allowing fluid pressure to deplete by porting fluid from the lift line 46 and from the lower line 50 back to the reservoir 22 through control valve 60 and through return line 31. The weight of the snowplow blade then causes the lift piston 36 to extend (move to the left in FIG. 2), which lowers the snowplow blade under its own weight. Keeping the third control valve 58 open in this configuration also allows the snowplow blade to be used in a "float" mode, in which the snowplow blade maintains its lowered position solely by its own weight. In the float mode, the snowplow blade may deflect upwards and downwards to accommodate small obstacles and/or changing terrain elevation. Normally, the snowplow blade is operated in the float mode.

When an operator determines that downforce is needed, the first step is to make sure the system is operating in float mode. In float mode, the third control valve 58 is open, which fluidly connects both the lift chamber 42 and the lower chamber 44 to the return line 31 through the fourth control valve 60, which is normally open. To activate the downforce mode, the operator selects a downforce function on the control panel. The control panel electrically signals the fourth control valve 60 to close, fluidly disconnecting the lift cylinder 18 from the return line 31. A downforce circuit 72 is formed by the second control valve 56, the lift line 46, the lower line 50, the third control valve 58, and the fourth control valve 60. The control panel then electrically signals the second control valve 56 to open and the control panel also electrically activates the hydraulic pump 24 for a predetermined period of time, preferably three seconds. The hydraulic pump 24 delivers pressurized hydraulic fluid through the supply line 30 and through the second control valve 56 to both the lift chamber 42 (through lift line 46) and to the lower chamber 44 (through the third control valve 58 and through lower line 50). After the predetermined period of time (i.e., three seconds), the hydraulic pump 24 turns off and the second control valve 56 closes, isolating the downforce circuit 72 from the rest of the hydraulic system.

As pressure in the lift line 46 and the lower line 50 builds to a desired pressure (about 750 psi in one embodiment, and preferably between 500 psi and 1000 psi), a pressure relief valve 70 begins to open, which limits pressure in the lift chamber 42 and in the lower chamber 44 to the desired pressure. Because the lift surface 48 of the piston 36 is smaller (i.e., has less area) than the lower surface 52 of the piston 36, the equal pressure in the lift chamber 42 and the lower chamber 44 produce unequal forces (because Force=Pressure× Area). More specifically, the larger lower surface 52 produces a greater force than the smaller lift surface 48. As a result, a net downforce (e.g., force to the left in FIG. 2) is generated by the piston 26. This net downforce transfers some of the vehicle weight from a front axle (through the mounting hardware) to the snowplow blade, which prevents inadvertent lifting of the snowplow blade due to certain environmental conditions (e.g., heavy wet snow), small obstacles (e.g., chunks of ice), or reverse plowing.

Because the angle cylinders 34*a*, 34*b*, and the first control valve 54 are separated from the downforce circuit 72, the angle cylinders 34*a*, 34*b* may advantageously be operated even in the downforce mode.

To cancel the downforce mode, the operator may select a lift function on the control panel. The control panel then electrically signals hydraulic motor to turn on and signals the second control valve 54 to port pressurized hydraulic fluid to the lift line 46 while simultaneously signaling the third control valve 58 to close. Alternatively, the downforce mode may be canceled by closing the third control valve 58, without activating the hydraulic pump 24, which returns the snowplow blade to the float mode.

If power is lost, or if the controller times out, the control valves 54, 56, 58, 60 return to their deenergized states. More specifically, the first control valve 54 is deenergized closed, the second control valve 56 is deenergized closed, the third control valve 58 is deenergized closed, and the fourth control valve 60 is deenergized open.

In the embodiment illustrated in FIG. 2, an optional hydraulic accumulator 80 is fluidly connected to the lower line 50. Because the downforce circuit 72 is essentially fluidly isolated from the rest of the system, the hydraulic accumulator 80 acts as a shock absorber, and as a temporary supply of pressure as the snowplow blade experiences forces greater than the downforce, which may cause the snowplow blade to deflect slightly. The hydraulic accumulator 80 maintains a constant hydraulic fluid pressure in the downforce circuit 72 when the downforce mode is activated. If snowplow blade deflection upward exceeds the capability of the hydraulic actuator 80 to absorb the additional hydraulic pressure, the pressure relief valve 70 acts as a safety device to prevent hydraulic pressure from exceeding a desired level.

Figure 3:
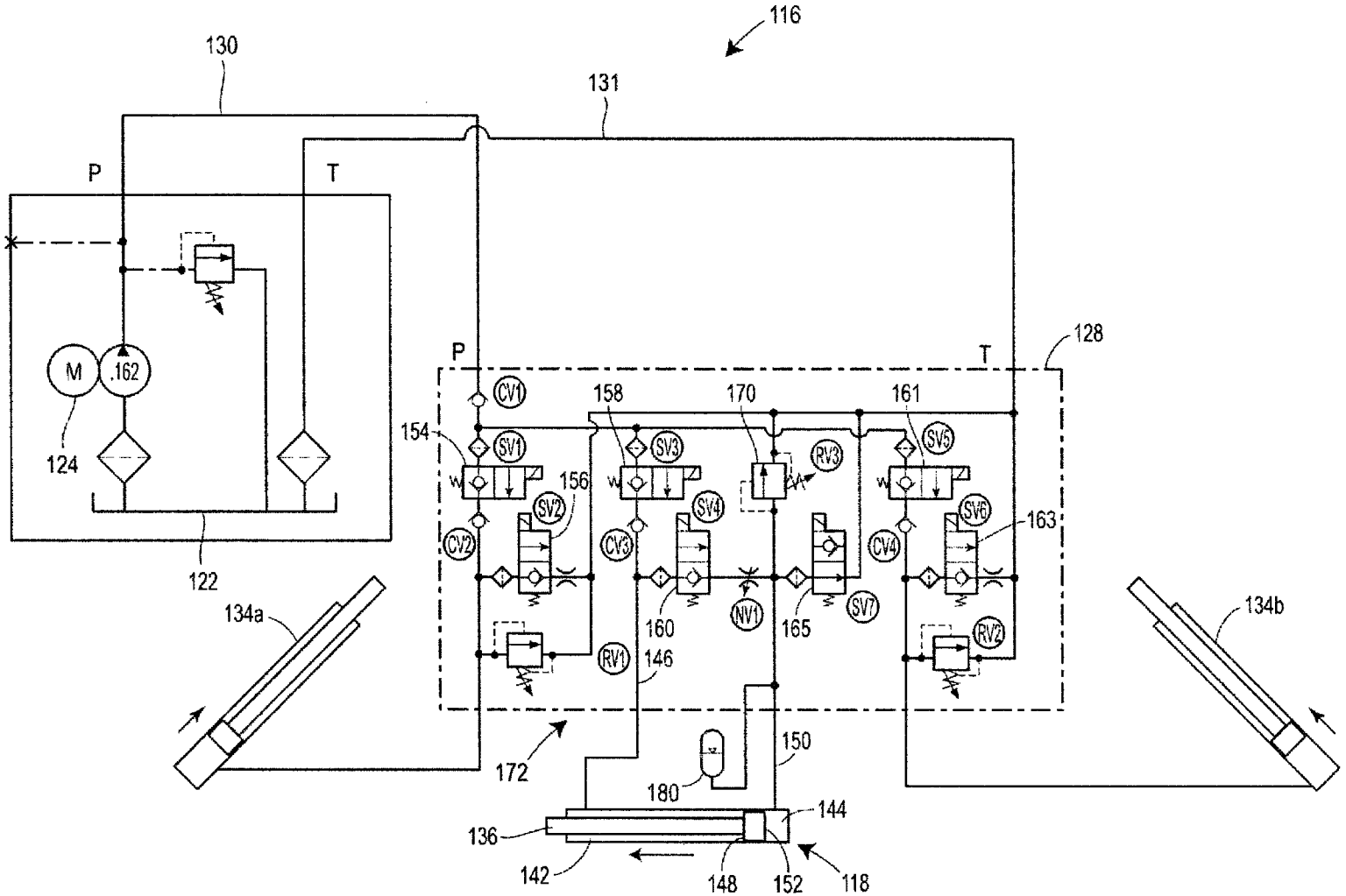
FIG. 3 is a schematic diagram of an alternate embodiment of a hydraulic articulating assembly with a passive downforce mechanism.

FIG. 3 illustrates an alternate embodiment of an articulating assembly 116 that may be used with a V-blade snowplow blade. Elements of the articulating assembly 116 of FIG. 3 that correspond to elements of the articulating assembly 16 of FIG. 2 have like reference numerals, but increased by 100. The articulating assembly 116 of FIG. 3 generally includes a hydraulic pump 124 that supplies pressurized hydraulic fluid from a reservoir 122 to a manifold 128. The manifold 128 directs the pressurized hydraulic fluid to one or more angle cylinders 134*a*, 134*b*, and/or to a lift cylinder 118. Like the manifold 28 of FIG. 2, the manifold 128 of FIG. 3 includes a first control valve 154, a second control valve 156, a third control valve 158, and a fourth control valve 160. The manifold 128 also includes a fifth control valve 161, a sixth control valve 163, and a seventh control valve 165.

The general principle of operation for the downforce mode of the manifold 128 is similar to the downforce mode of the manifold 28 of FIG. 2, which is to isolate a downforce circuit 172 from the rest of the hydraulic system. Thus, only differences between the two manifolds will be discussed further below.

When an operator determines that downforce is needed, the first step is to make sure the system is operating in float mode. In float mode, the fourth control 160 valve is open, which fluidly connects both the lift chamber 142 and the lower chamber 144 to the return line 131 through the seventh control valve 165, which is normally open. To activate the downforce mode, the operator selects a downforce function on the control panel. The control panel electrically signals the seventh control valve 165 to close, fluidly disconnecting the lift cylinder 118 from the return line 131. A downforce circuit 172 includes the third control valve 158 the lift line 146, the lower line 150, the fourth control valve 160 and the seventh control valve 165. The control panel then electrically signals the third control valve 158 to open and the control panel also electrically activates the hydraulic pump 124 for a predetermined period of time (e.g., three seconds). The hydraulic pump 124 delivers pressurized hydraulic fluid through the supply line 130 and through the third control valve 158 to both the lift chamber 142 (through lift line 146) and to the lower chamber 144 (through the fourth control valve 160 and through the lower line 150). After the predetermined period of time (i.e., three seconds), the hydraulic pump 124 turns off and the third control valve 158 closes, isolating the downforce circuit 172 from the rest of the hydraulic system.

As pressure in the lift line 146 and the lower line 150 builds to a desired pressure (about 750 psi in one embodiment, preferably in the range from 500 psi to 1000 psi), a pressure relief valve 170 begins to open, which limits pressure in the lift chamber 142 and in the lower chamber 144 to the desired pressure. Because the lift surface 148 of the piston 136 is smaller (i.e., has less area) than the lower surface 152 of the piston 136, the equal pressure in the lift chamber 142 and the lower chamber 144 produces unequal forces. More specifically, the larger lower surface 152 produces a greater force than the smaller lift surface 148. As a result, a net downforce (e.g., force to the left in FIG. 3) is generated by the piston 136. This net downforce transfers some of the vehicle weight from a front axle (through the mounting hardware) to the snowplow blade, which prevents inadvertent lifting of the snowplow blade due to certain environmental conditions (e.g., heavy wet snow), small obstacles (e.g., chunks of ice), or reverse plowing.

In the embodiment of FIG. 3, the first control valve 154 and the second control valve 156 control movement of the first angle cylinder 134*a* and the fifth control valve 161 and the sixth control valve 163 control movement of the second angle cylinder 134*b*.

The disclosed articulator assembly downforce mechanism may be considered passive because the mechanism does not rely on any sort of feedback mechanism or monitoring of hydraulic pressure in the downforce circuit. Once the downforce mechanism is activated, downforce is applied and maintained without constant monitoring. The hydraulic accumulator and the pressure relief valve maintain hydraulic pressure in the downforce circuit without feedback from sensors. As a result, the hydraulic pump is subject to far less cycles during downforce mode operation than previous downforce systems. Moreover, the hydraulic accumulator absorbs hydraulic shocks as the snowplow blade moves during plowing operations, which prevents the shocks from being transferred to the vehicle chassis. As a result, the operator has a smoother ride.

Although certain downforce mechanisms have been described herein in accordance with the teachings of the present disclosure, the scope of the appended claims is not limited thereto. On the contrary, the claims cover all embodiments of the teachings of this disclosure that fairly fall within the scope of permissible equivalents.

We claim:

1. A snowplow blade articulator assembly comprising:

a mounting frame for attaching a snowplow blade to a vehicle chassis;

a hydraulic pump attached to the mounting frame;

a hydraulic reservoir attached to the mounting frame, the hydraulic reservoir supplying hydraulic fluid to the hydraulic pump;

an articulating assembly attached to the mounting frame for moving the snowplow blade when the snowplow blade is attached to the mounting frame, the articulating assembly being fluidly connected to the hydraulic pump, the articulating assembly including a lift cylinder and a hydraulic manifold;

wherein the hydraulic manifold includes a downforce circuit that fluidly isolates the lift cylinder from the hydraulic pump when a first control valve is closed and the downforce circuit fluidly connects a lift chamber of the lift cylinder with a lower chamber of the lift cylinder to maintain equal hydraulic pressure in the lift chamber and in the lower chamber.

2. The snowplow blade articulator assembly of claim 1, wherein the lift cylinder includes a piston that divides the lift cylinder into the lift chamber and the lower chamber.

3. The snowplow blade articulator assembly of claim 2, wherein the piston includes a lift surface in the lift chamber, hydraulic fluid acting on the lift surface to produce a lifting force for the snowplow blade, and the piston includes a lower surface in the lower chamber, hydraulic fluid acting on the lower surface to produce a lowering force for the snowplow blade.

4. The snowplow blade articulator assembly of claim 3, wherein the lift surface is smaller than the lower surface.

5. The snowplow blade articulator assembly of claim 1, further comprising a hydraulic accumulator that is fluidly connected to the downforce circuit.

6. The snowplow blade articulator assembly of claim 1, further comprising a second control valve disposed downstream of the first control valve, the second control valve operating to fluidly connect a lift line to a lower line in the downforce circuit.

7. The snowplow blade articulator assembly of claim 6, further comprising a third control valve downstream of the second control valve, the third control valve operating to fluidly isolate the downforce circuit when the first control valve is closed.

8. The snowplow blade articulator assembly of claim 7, further comprising a pressure relieve valve downstream of the second control valve, in parallel with the third control valve, the pressure relief valve operating to fluidly connect the downforce circuit to a return line when pressure in the downforce circuit exceeds a predetermined value.

9. The snowplow blade articulator assembly of claim 8, wherein the predetermined value is about 750 psi.

10. The snowplow blade articulator assembly of claim 1, further including an angle cylinder for changing an angle of a snowblade.

11. The snowplow blade articulator assembly of claim 7, further comprising a fourth control valve that controls fluid flow to the angle cylinder, the fourth control valve being arranged in parallel with the first control valve.

* * * * *